United States Patent [19]

Scheurecker et al.

[11] 4,341,257

[45] Jul. 27, 1982

[54] ARRANGEMENT FOR LOCATING ROLLERS WITH AN INCREASED ROTATORY RESISTANCE IN A ROLLER WAY

[75] Inventors: Werner Scheurecker, Linz; Josef Wirth, Leonding; Reinhold Angerer, Linz, all of Austria

[73] Assignee: Voest-Alpine Aktiengesellschaft, Werksgelande, Austria

[21] Appl. No.: 193,395

[22] Filed: Oct. 2, 1980

[30] Foreign Application Priority Data

Oct. 22, 1979 [AT] Austria ..... 6873/79

[51] Int. Cl.[3] ..... B22D 11/00

[52] U.S. Cl. ..... 164/150; 72/21; 324/208; 164/451

[58] Field of Search ..... 164/150, 151, 154, 4.1, 164/451, 459, 418; 324/207, 208, 226; 340/682, 683; 308/20; 73/432 R; 116/281, 282, 283; 72/21

[56] References Cited

U.S. PATENT DOCUMENTS 3,853,087 12/1974 Aldag ..... 340/682 X

FOREIGN PATENT DOCUMENTS 1222006 6/1960 France ..... 324/208
55-73452 6/1980 Japan ..... 164/150
55-133856 10/1980 Japan ..... 164/151

*Primary Examiner*—Gus T. Hampilos
*Assistant Examiner*—K. Y. Lin
*Attorney, Agent, or Firm*—Brumbaugh, Graves, Donohue & Raymond

[57] ABSTRACT

In order to be able to locate stuck rollers of a roller way as early as possible, with longer operational interruptions being avoided and the demounting of constructional parts of the roller way being not necessary, an arrangement for this purpose includes a supporting body which is movable along the roller way and carries a frictional head. The frictional head is pressable against the surface areas of subsequently arranged rollers. Means are provided for recording and measuring a difference between the velocity of the supporting body with which the latter is moved along the roller way and the velocity of the frictional head getting into contact with a roller.

15 Claims, 8 Drawing Figures

ARRANGEMENT FOR LOCATING ROLLERS WITH AN INCREASED ROTATORY RESISTANCE IN A ROLLER WAY

BACKGROUND OF THE INVENTION

The invention relates to an arrangement for locating rollers with an increased rotatory resistance in a roller way, in particular strand guiding rollers in a continuous casting plant.

In continuous casting plants, the strand is guided between two oppositely arranged roller ways and cooled, after having left the continuous casting mould, i.e at least over a distance corresponding to the length of the liquid phase of the strand. The rollers of these roller ways have relatively small diameters and are arranged as closely adjacent as possible in order to effectively prevent bulging of the strand. The rollers are held, and surrounded, by a framework. Due to the compact construction of the rollers and the framework, the rollers are difficult to reach from outside.

Due to the high thermal stress of the rollers by the red-hot strand having a liquid core as well as by the cooling water, a failure of the roller bearings may occur so that individual rollers of the roller ways will get stuck or are difficult to rotate. Not only is this disadvantageous to the quality of the strand, but it also constitutes a danger to the entire plant, since the strand will drag along the stuck rollers, thus possibly leading to a rupture of the thin strand skin and, accordingly, to a strand breakthrough.

SUMMARY OF THE INVENTION

The present invention aims at detecting as early as possible rollers that have become stuck. This should be possible without long interruptions in operation. In particular the detection of stuck rollers is to be feasible without the necessity of demounting structural parts of the roller way.

This object is achieved according to the invention by a supporting body which is movable along the roller way and carries a frictional head, which frictional head is pressable against the surface areas of subsequently arranged rollers, and an arrangement is provided for recording and measuring a difference in the velocity of the supporting body with which it is moved along the roller way and the velocity of that part of the frictional head which comes into contact with a roller. The supporting body can be coupled to the starter bar and moved with the starter bar between the roller ways, which constitutes routine work in continuous casting plants, requiring only very little time.

Advantageously, the supporting body comprises at least one surface that is in contact with the rollers of one roller way, and the frictional head is resiliently mounted on the supporting body, thereby being movable from a position projecting beyond the surface into a position in alignment with the surface, when coming into contact with a roller.

According to a preferred embodiment, the frictional head is designed as a frictional wheel, the frictional wheel being pressable with its circumference against the surface area of a roller, and an arrangement is provided which indicates a rotatory movement of the frictional wheel.

Suitably, the frictional wheel is mounted on a pivot arm arranged on the supporting body, wherein the pivot axis of the pivot arm is directed parallel to the axis of the frictional wheel and the pivot arm is movable by spring means towards a stop delimiting its movement towards the rollers.

According to another advantageous embodiment, the frictional wheel is mounted to be slideable along a guide and is pressable, by spring means, against a stop delimiting its movement towards the rollers.

It is advantageous, if the frictional wheel serves as drive for a cam disk whose cams initiate signals upon rotatory movement, preferably by closing an electric contact.

The frictional wheel suitably may also be connected with a tachometer generator.

According to a further preferred embodiment, the frictional head is designed as a piston which is pressable against the surface area of a roller at an approximately right angle to the roller way and which is mounted on the supporting body so as to be displaceable in the moving direction of the supporting body along guides, wherein a means for recording and measuring a relative movement of the piston relative to the supporting body in the moving direction of the supporting body is provided.

Suitably, this piston in this embodiment is mounted on a car that is displaceable in the moving direction of the supporting body, which car preferably is displaceable by means of longitudinal guides on rollers provided at the supporting body, wherein distance indicators, such as a magnetic coil with an iron core, or electric contacts, are provided on the car and on the supporting body for recording a relative movement between the car and the supporting body.

Preferably, the surface of the supporting body that is in contact with the roller way is formed by an elastically deformable steel strip.

BRIEF DESCRIPTION OF THE DRAWINGS

The invention will now be explained in more detail by way of three embodiments and with reference to the accompanying drawings, wherein.

DESCRIPTION OF EXEMPLARY EMBODIMENTS

Figure 1:
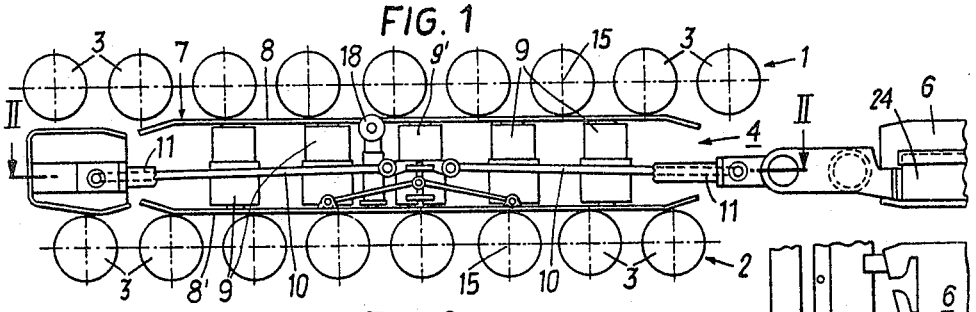
FIG. 1 is a side view of an arrangement according to the invention in a first embodiment.
Figure 2:
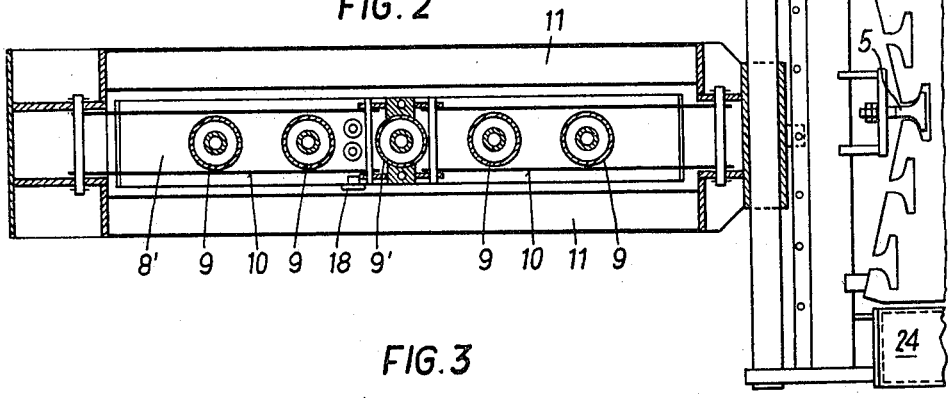
FIG. 2 is a section along line II—II of FIG. 1.
Figure 3:
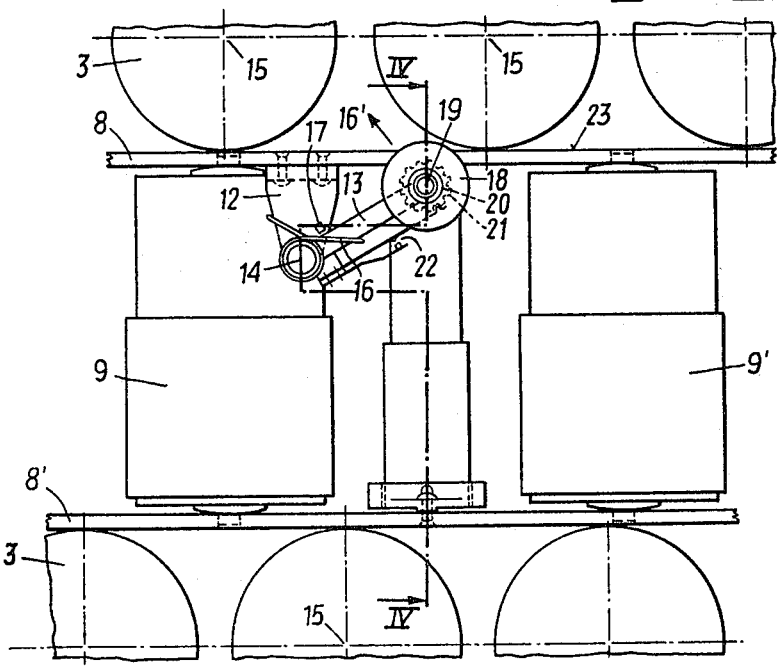
FIG. 3 is a detail of FIG. 1 on an enlarged scale.
Figure 4:
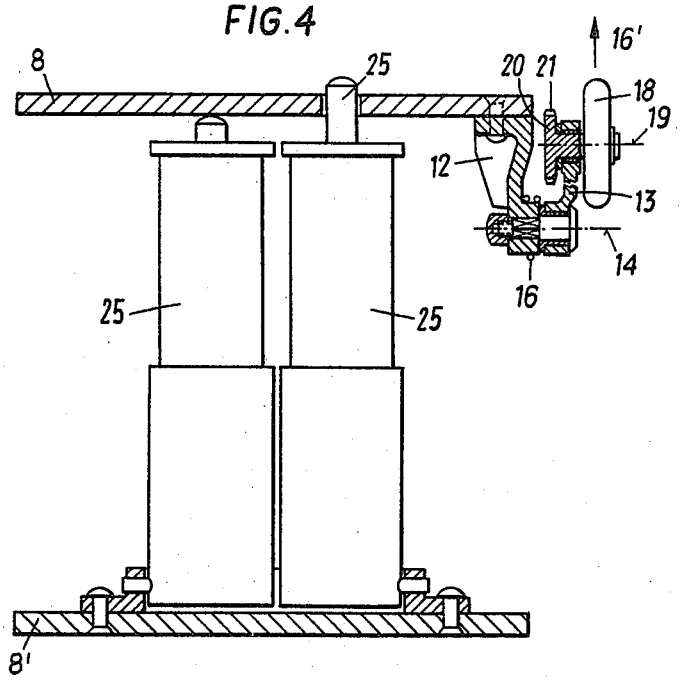
FIG. 4 is a section along line IV—IV of FIG. 3 according to this embodiment.

Between roller ways 1 and 2, comprising rollers 3, of a strand guide of a continuous casting plant, an arrangement 4 for locating stuck rollers is inserted. It is connected with a dummy bar 6 by means of a coupling 5. The arrangement comprises a supporting body 7 which is formed of two oppositely arranged, elastically deformable steel strips 8, 8' that are pressed apart by spring cups 9, 9' arranged one behind the other. Thereby the steel strips 8, 8' come into contact with the rollers 3 of the roller ways 1 and 2. By pulling or pushing through the supporting body 7, the rollers 3 that have not become stuck are set in rotation. Instead of the spring cups 9, 9', also hydraulically or pneumatically actuated pistons or the like, which press the steel strips 8, 8' apart, could be provided.

The supporting body 7 is articulately connected with the coupling 5 via the middle spring cup 9' by rods 10 and laterally arranged longitudinal beams 11. On one of the steel strips 8, a console 12 is riveted to which a pivot arm 13 is hinged, the pivot axis 14 extending parallel to the axes 15 of the rollers 3 of the strand guideways. The pivot arm is constantly moved by means of a spring 16 in the direction of arrow 16', i.e. towards the roller ways. A stop 17 for the pivot arm 13 takes care that the pivot arm will not be pressed too much towards the rollers 3. On the free end of the pivot arm 13 a frictional head, which is designed as a frictional wheel 18, is rotatably mounted. The axis 19 about which the frictional wheel 18 is rotatable is directed parallel to the pivot axis 14 of the pivot arm. A cam disk 20 is coaxially fastened to the frictional wheel 18, the cams 21 of the cam disk closing an electric contact 22 in the event of a rotatory movement of the frictional wheel 18.

The arrangement functions in the following manner: The steel strips 8, 8', which are spread by the spring cups 9, 9' come into contact with the rollers 3 of the roller ways 1, 2, wherein, after having overcome the bearing play of the rollers 3, the latter are turned, provided they are not stuck, due to the pulling of the arrangement 4 between the roller ways 1, 2. The circumferential speed of the rollers corresponds to the transporting speed of the supporting body 7. The frictional wheel 18, which is resiliently pressed against the rollers 3, will not perform a rotary movement relative to the supporting body 7 when in contact with the rollers, if the rollers rotate, since the circumference of the frictional wheel 18 is moved so as to pass by the rollers 3 at the transporting speed of the supporting body 7. The frictional wheel 18 merely is pushed back from its position projecting beyond the steel strip 8, until the circumference of the frictional wheel 18 is in alignment with the steel strip 8, which is in contact with the surface areas of the rollers 3. If the frictional wheel comes into contact with a stuck roller 3 or with a roller 3 that rotates only with difficulty—with such a roller there is a sliding movement between the contacting surface 23 of the steel strip 8 and the surface of the roller—the frictional wheel 18 is set in rotation and the electric contact 22 is closed. The closing of the electric contact is used for conducting a signal to a recording means, which is accommodated for instance in a box 24 mounted at the arrangement 4. With the help of a wireless transmission of the signals, it would also be possible to arrange the recording means for instance on a stationary control stand, independently of the supporting body 7. If the recording means, in addition to each signal, also records the respective position of the supporting body within the roller ways, the position of the stuck roller can be immediately determined. The position of a stuck roller can be recorded in connection with an axially movable tracing pin 25 projecting beyond the steel strip, which tracing pin is pushed down by each strand guiding roller 3 is passes, thus initiating a signal. Instead of by the electric contact, signals can be triggered also in other manners, for instance pneumatically.

For checking the rollers 3 of the lower roller way 2, the arrangement 4 is turned about its longitudinal axis by 180° and again moved between the roller ways. It is also possible to provide a frictional wheel 18 on both steel strips 8, 8' so that the location of stuck rollers is possible in one operational step at both roller ways 1, 2.

Figure 5:
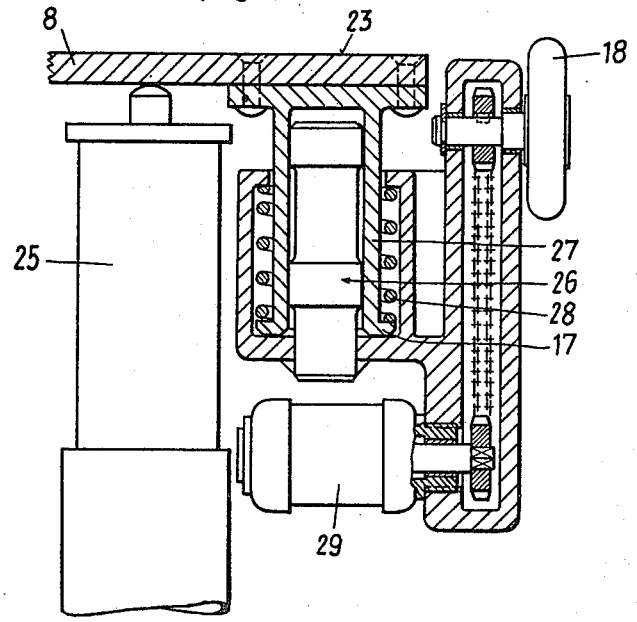
FIG. 5 shows a further embodiment in an illustration analogous to FIG. 4.

In the embodiment illustrated in FIG. 5 the frictional wheel 18 is displaceable along a guide 26 which is directed perpendicularly to the contact face 23 of the steel strip 8. The guide is designed as a piston sliding at a cylinder 27 which is fastened to the steel strip 8. A spring 28 serves for pressing the frictional wheel 18 against the strand guiding rollers, a stop 17 again limiting the movement towards the rollers 3. A rotatory movement of the frictional wheel 18 is transferred to a tachometer generator 29 which initiates a signal to a recording device, according to the rotatory movement of the frictional wheel.

The perpendicular movement of the frictional wheel 18 inclusive of the casing and the piston 26, which occurs every time the arrangement is pressed down by a strand guiding roller, can be used in the same way as the movement of an axially movable tracing pin 25 in the form of an output signal for recording the position of the roller in question.

Figure 6:
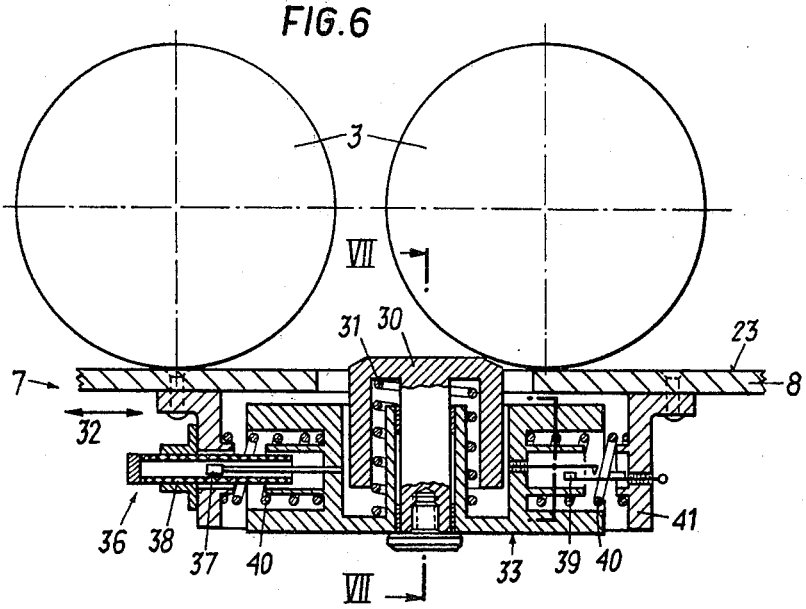
FIG. 6 represents a third embodiment sectioned perpendicularly to the roller axes of the roller ways.
Figure 8:
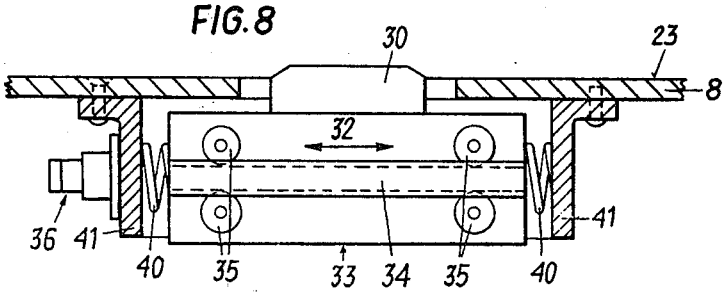
FIG. 8 is a section along line VIII—VIII of FIG. 7.
Figure 7:
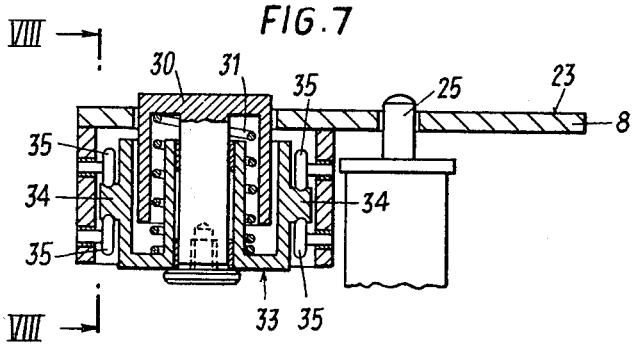
FIG. 7 illustrates a section along line VII—VII of FIG. 6.

In the embodiment illustrated in FIGS. 6 to 8 the frictional head is designed as a piston 30 which is mounted so as to be displaceable approximately perpendicular to the contact face 23 of the steel strip 8 and is pressed outwardly by a spring 31, beyond the contact face 23. The piston 30 is mounted on a car 33 which is displaceable in the moving direction of the supporting body 7, which direction is indicated by the double arrow 32. The car 33 comprises longitudinal guides 34, which are in contact with the rollers 35 arranged on the supporting body 7. For indicating a relative movement of the piston 30 relative to the supporting body 7 in the moving direction of the supporting body 7—such a relative movement occurs when the piston comes into contact with a roller 3 that has got stuck or is difficult to rotate—an inductive distance indicator 36 is provided, as is illustrated in FIG. 6 on the left-hand side. In this case, an iron core 37 mounted in the car 33 moves into a magnetic coil 38 that is fastened to the supporting body 7. Instead of the inductive distance indicator, it is also possible to provide a distance indicator that is designed as an electric contact 39, as is illustrated in FIG. 6 on the right-hand side. The car 33 is held in the mid-position, as long as the piston 30 does not carry out a relative movement relative to the supporting body 7 in the longitudinal direction of the same, due to a stuck roller 3, by means of two springs 40, each of which leans against the car 33 and against consoles 41 which are fastened on the steel strip 8.

What we claim is:

1. An arrangement for locating rollers with an increased rotatory resistance in a roller way such as strand guiding rollers in a continuous casting plant, which arrangement comprises a supporting body movable along said roller way, a frictional head provided on said supporting body and pressable to the surface area of subsequently arranged rollers, means for moving said supporting body along said roller way, and means for indicating and recording a difference between the velocity of said supporting body with which said supporting body moves along said roller way and the velocity of that part of said frictional head which comes into contact with a roller.

2. An arrangement as set forth in claim 1, wherein said supporting body comprises at least one contact face contacting the rollers of a roller way, and said frictional head is resiliently mounted on said supporting body, said frictional head, when in contact with a roller, being movable from a position projecting beyond said contact face into a position in alignment with said contact face.

3. An arrangement as set forth in claim 1, wherein said frictional head is designed as a frictional wheel, said frictional wheel being pressable with its circumference against the surface area of a roller, and further comprising means for indicating a rotatory movement of said frictional wheel.

4. An arrangement as set forth in claim 3, further comprising a pivot arm mounted on said supporting body for supporting said frictional wheel, the pivot axis of said pivot arm being directed parallel to the axis of said frictional wheel, a stop for delimiting the movement of said pivot arm towards said rollers, and spring means for moving said pivot arm towards said stop.

5. An arrangement as set forth in claim 3, further comprising a guide for mounting said frictional wheel so as to be slideable along said guide, a stop for delimiting the movement of said frictional wheel towards said rollers, and pressing spring means for pressing said frictional wheel against said stop.

6. An arrangement as set forth in claim 3 or 4, further comprising a cam disk including cams, and wherein said frictional wheel serves for driving said cam disk, said cams initiating signals upon rotatory movement of said frictional wheel.

7. An arrangement as set forth in claim 3 or 4, further comprising a cam disk including cams, and wherein said frictional wheel serves for driving said cam disk, said cams closing an electric contact upon rotatory movement of said frictional wheel.

8. An arrangement as set forth in claim 5, further comprising a tachometer generator connected to said frictional wheel.

9. An arrangement as set forth in claim 1, wherein said frictional head is designed as a piston that is pressable against the surface area of a roller approximately at a right angle to the roller way, which arrangement further comprises guides for mounting said piston on said supporting body so as to be displaceable along said guides in the moving direction of said supporting body, and means for indicating and recording a relative movement of said piston relative to said supporting body in the moving direction of said supporting body.

10. An arrangement as set forth in claim 9, further comprising a car displaceable in the moving direction of said supporting body, said piston being mounted on said car.

11. An arrangement as set forth in claim 10, further comprising longitudinal guides and supporting body rollers provided on said supporting body for displacing said car along said longitudinal guides on said supporting body rollers.

12. An arrangement as set forth in claim 10, wherein said means for indicating and recording comprising distance indicators provided on said car and on said supporting body for indicating a relative movement between said car and said supporting body.

13. An arrangement as set forth in claim 12, wherein said distance indicators are designed as a magnetic coil including an iron core.

14. An arrangement as set forth in claim 12, wherein said distance indicators are designed as electric contacts.

15. An arrangement as set forth in claim 2, wherein said at least one contact face of said supporting body is formed by an elastically deformable steel strip.

* * * * *

UNITED STATES PATENT AND TRADEMARK OFFICE

CERTIFICATE OF CORRECTION

PATENT NO. : 4,341,257

DATED : July 27, 1982

INVENTOR(S) : Scheurecker et al.

It is certified that error appears in the above—identified patent and that said Letters Patent is hereby corrected as shown below:

First page, Item 73, "Werksgelande" should read --Linz--.

Col. 3, line 62, "is" should read --it--.

Col. 6, line 24, "comprising" should read --comprises--.

Signed and Sealed this

Second Day of November 1982

[SEAL]

*Attest:*

GERALD J. MOSSINGHOFF

*Attesting Officer* *Commissioner of Patents and Trademarks*